US009033190B2

(12) United States Patent
Alluigi

(10) Patent No.: US 9,033,190 B2
(45) Date of Patent: May 19, 2015

(54) TRIGGER DISPENSER DEVICE

(75) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 45 days.

(21) Appl. No.: 13/882,432

(22) PCT Filed: Sep. 6, 2011

(86) PCT No.: PCT/IB2011/053898

§ 371 (c)(1),
(2), (4) Date: Apr. 29, 2013

(87) PCT Pub. No.: WO2012/069939

PCT Pub. Date: May 31, 2012

(65) Prior Publication Data

US 2013/0221033 A1 Aug. 29, 2013

(30) Foreign Application Priority Data

Nov. 22, 2010 (IT) ..... BS2010A0187

(51) Int. Cl.
*B67D 7/58* (2010.01)
*B05B 11/00* (2006.01)

(52) U.S. Cl.
CPC ..... *B05B 11/3023* (2013.01); *B05B 11/3011* (2013.01); *B05B 11/3043* (2013.01); *B05B 11/3057* (2013.01); *B05B 11/3064* (2013.01)

(58) Field of Classification Search
CPC ..... B05B 11/3064; B05B 11/3033; B05B 11/007; B05B 1/3093
USPC ..... 222/321.7–321.8, 382, 383.1, 380, 182, 222/340, 341, 384, 548
See application file for complete search history.

(56) References Cited

U.S. PATENT DOCUMENTS

| | | | | | |
|---|---|---|---|---|---|
| 4,161,288 | A | * | 7/1979 | McKinney | 239/333 |
| 4,191,313 | A | * | 3/1980 | Blake et al. | 222/335 |
| 4,452,379 | A | * | 6/1984 | Bundschuh | 222/207 |
| 5,228,602 | A | * | 7/1993 | Maas et al. | 222/340 |
| 5,244,126 | A | * | 9/1993 | Geier | 222/383.1 |
| 5,575,407 | A | * | 11/1996 | Foster et al. | 222/324 |
| 5,706,984 | A | * | 1/1998 | Tada et al. | 222/182 |
| 5,984,149 | A | * | 11/1999 | Thanisch et al. | 222/340 |
| 6,116,472 | A | * | 9/2000 | Wanbaugh et al. | 222/340 |
| 6,267,271 | B1 | * | 7/2001 | Tsuchida et al. | 222/383.1 |
| 6,641,003 | B1 | * | 11/2003 | Foster et al. | 222/383.1 |

(Continued)

FOREIGN PATENT DOCUMENTS

| | | | |
|---|---|---|---|
| EP | 1 137 493 B1 | | 12/1999 |
| EP | 1716932 | * | 4/2005 |
| WO | 2010/124040 A2 | | 10/2010 |

OTHER PUBLICATIONS

International Search Report and Written Opinion of the ISA for PCT/IB2011/053898, ISA/EP, Rijswijk, NL, mailed Jan. 12, 2012.

*Primary Examiner* — Paul R Durand
*Assistant Examiner* — Randall Gruby
(74) *Attorney, Agent, or Firm* — Harness, Dickey & Pierce, P.L.C.

(57) ABSTRACT

A trigger dispenser device for a liquid provides an integral valve element comprising a suction duct and at least one flexible suction lip to obstruct the suction duct during the dispensing phase, and an annular obturator and a flexible flange supporting it, for opening the pressure chamber toward the dispenser duct during the dispensing phase.

16 Claims, 8 Drawing Sheets

(56) References Cited

U.S. PATENT DOCUMENTS

| | | | | |
|---|---|---|---|---|
| 7,175,056 | B2 * | 2/2007 | Buti | 222/383.1 |
| 7,497,358 | B2 * | 3/2009 | Clynes et al. | 222/340 |
| 7,735,689 | B2 * | 6/2010 | Alluigi | 222/153.13 |
| 8,104,646 | B2 * | 1/2012 | Foster et al. | 222/383.1 |
| 2005/0092778 | A1 * | 5/2005 | Bistolfi | 222/383.1 |
| 2005/0189381 | A1 * | 9/2005 | Tsuchida | 222/383.1 |
| 2007/0131718 | A1 * | 6/2007 | Bistolfi | 222/189.09 |
| 2007/0210117 | A1 * | 9/2007 | Foster et al. | 222/340 |
| 2007/0215647 | A1 * | 9/2007 | Foster et al. | 222/383.1 |
| 2007/0295757 | A1 * | 12/2007 | Foster et al. | 222/340 |
| 2009/0152304 | A1 * | 6/2009 | Foster | 222/340 |
| 2013/0256339 | A1 * | 10/2013 | Alluigi et al. | 222/383.1 |

* cited by examiner

TRIGGER DISPENSER DEVICE

The present invention relates to a manual dispenser device of a liquid, preferably a trigger dispenser device.

Trigger dispenser devices are extremely widespread, and used in various sectors, for example to spray liquid household detergents, deodorant liquids, liquids for ironing clothes. The production volumes of such devices are enormous; today, several hundred million pieces are produced per year.

It is therefore clear that an improvement of a structural characteristic of a component of the dispenser device or the improvement of a step of the production process has considerable economic impact.

In the sector in question, much of the R&D into new components has been directed at combining a multiplicity of functions in single component, especially in the case in which such component can be moulded.

In particular, trigger dispenser devices are known of in which a single component combines various valve functions.

For example, document EP 1137493 shows a component which combines the functions of a suction valve, which prevents the aspirated liquid from returning to the container, and those of a delivery valve of the liquid toward the dispenser duct.

According to a further example, document WO 2010/124040 shows a component which combines the functions of suction, delivery valve and attachment for the suction tube.

However, such component shows functioning limits of the delivery valve which tends to open and let the liquid out even at low levels of pressure exerted by the liquid; it is said, in other words, that it is a "weak" delivery valve.

The purpose of the present invention is to make a manual dispenser device of the liquid, in particular, a trigger dispenser device, which satisfies the aforesaid requirements and contemporarily overcomes the drawbacks mentioned with reference to the prior art.

Such purpose is achieved by a manual dispenser device made according to claim 1.

The characteristics and advantages of the manual dispenser device according to the present invention will be evident from the following description, made by way of a non-limiting example, with reference to the attached drawings, wherein.

Figure 1:
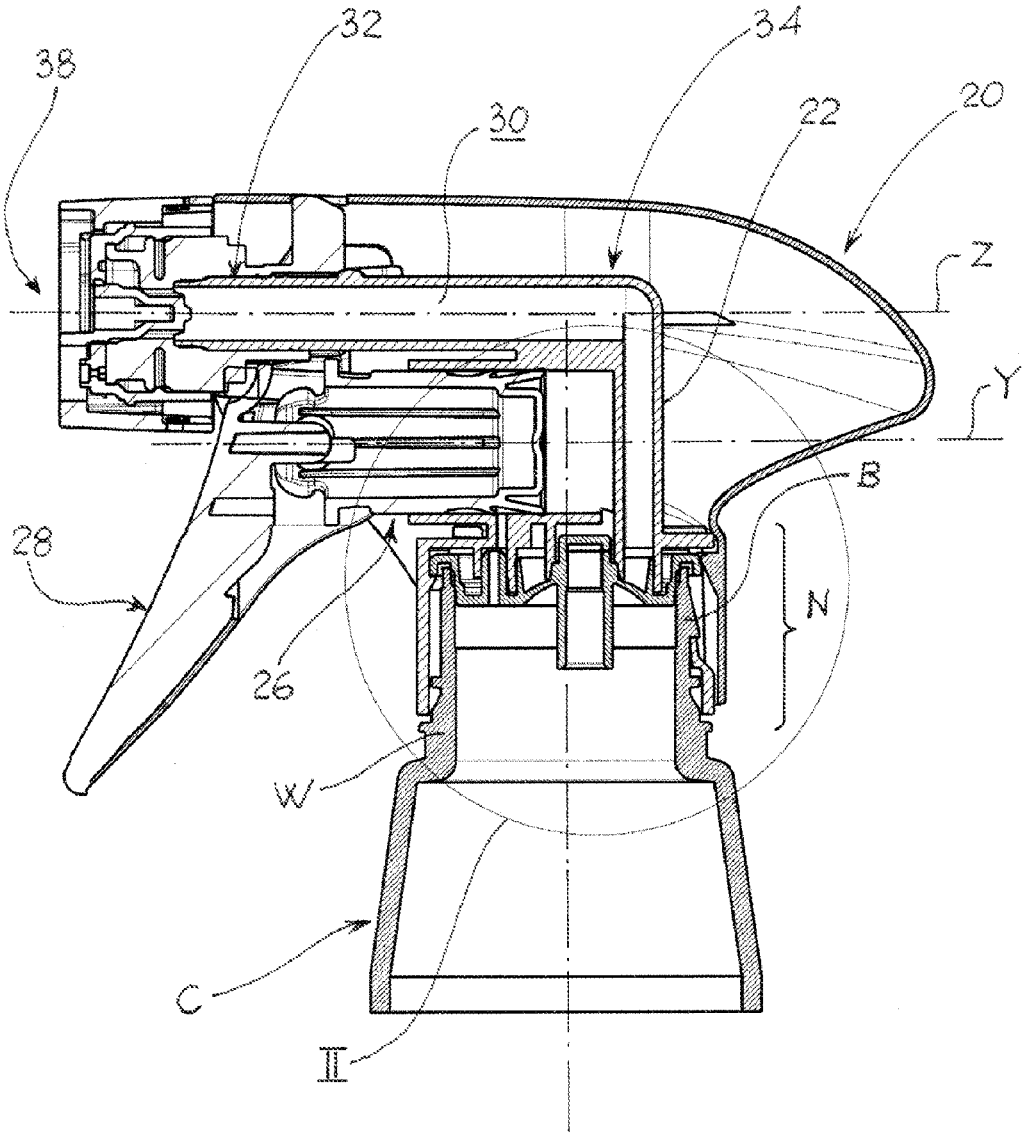
FIG. 1 shows a cross-section view of a neck a container and a dispenser head attached to it fitted with a valve element, according to one embodiment of the present invention.
Figure 4A:
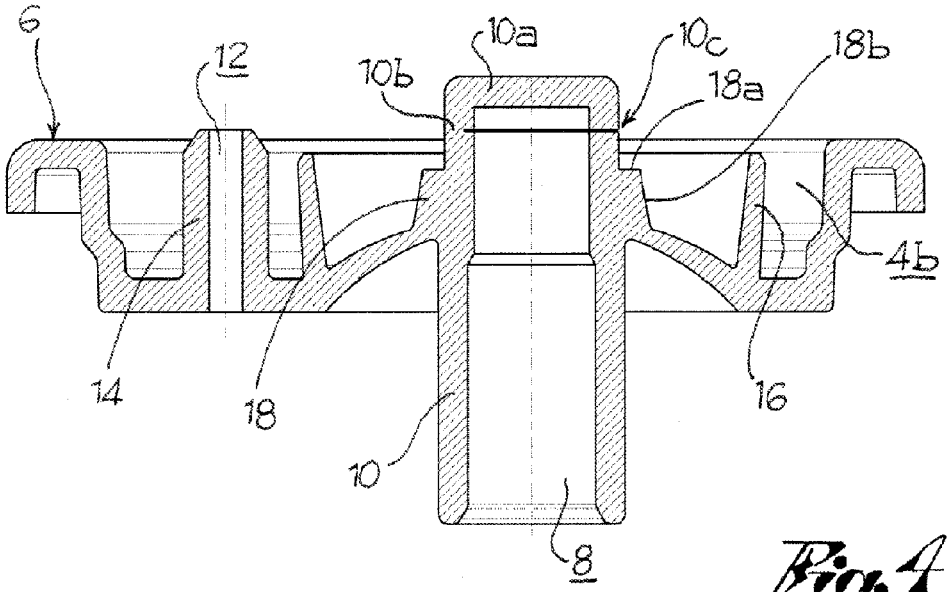
Figure 4B:
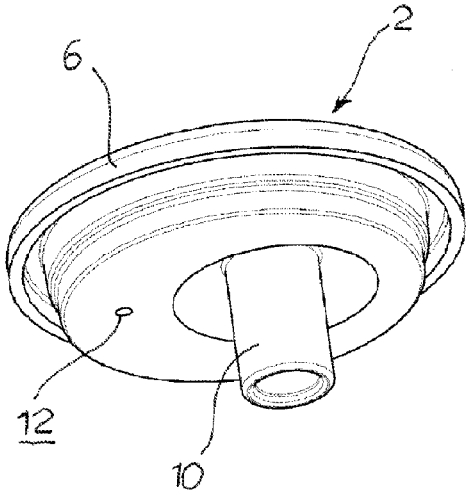
Figure 4C:
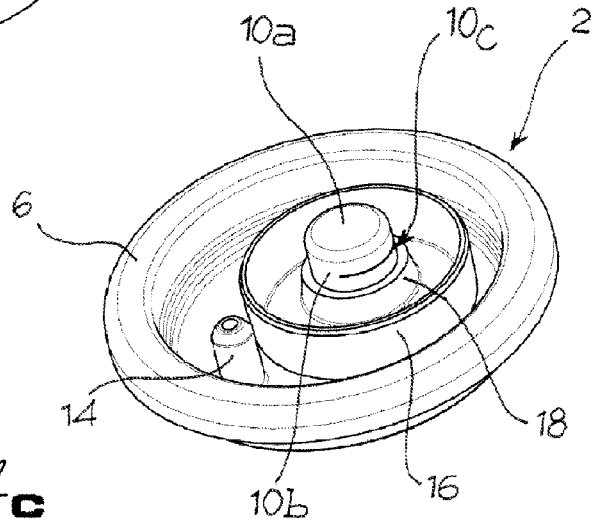

FIG. 4*a* shows a cross-section view of the valve element in FIG. 1;

FIGS. 4*b* and 4*c* show axonometric views respectively from below and from above of the valve element in FIG. 4*a;*

Figure 5:
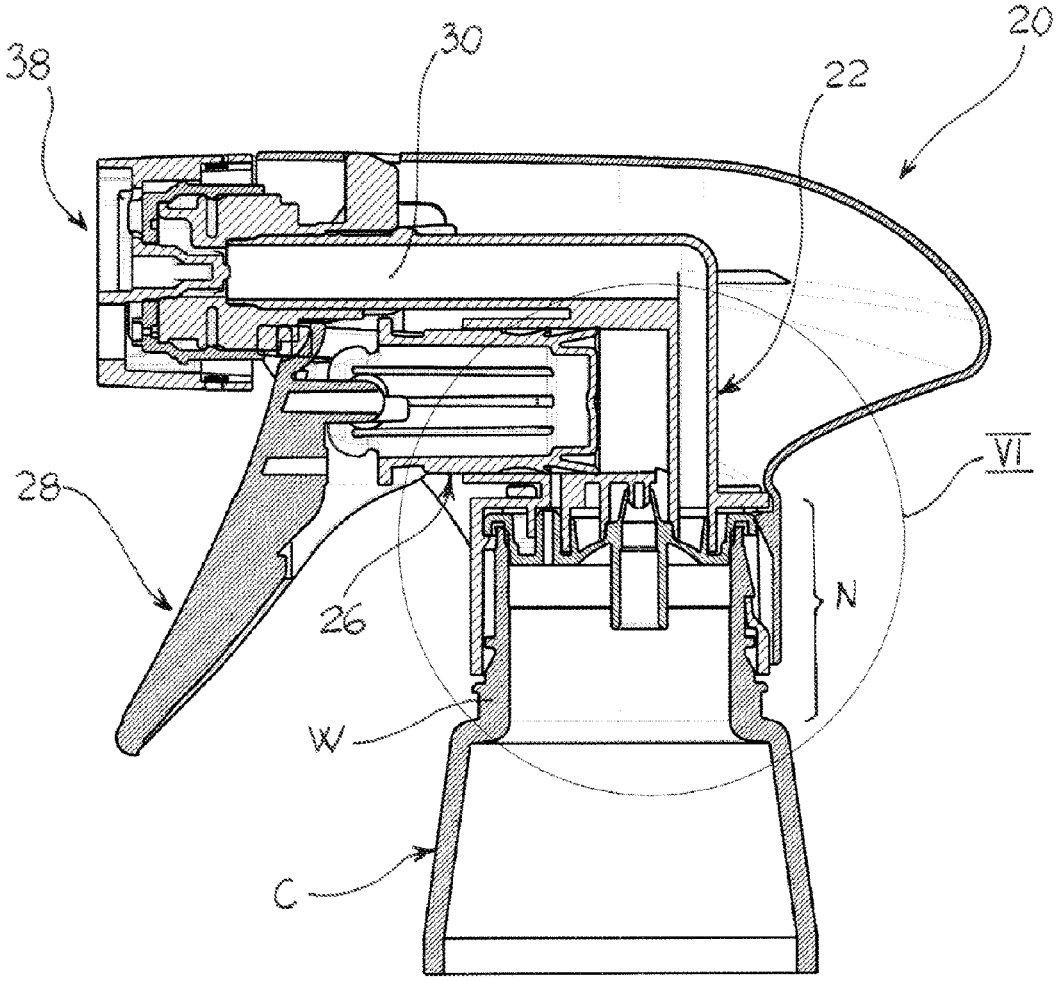
Figure 6:
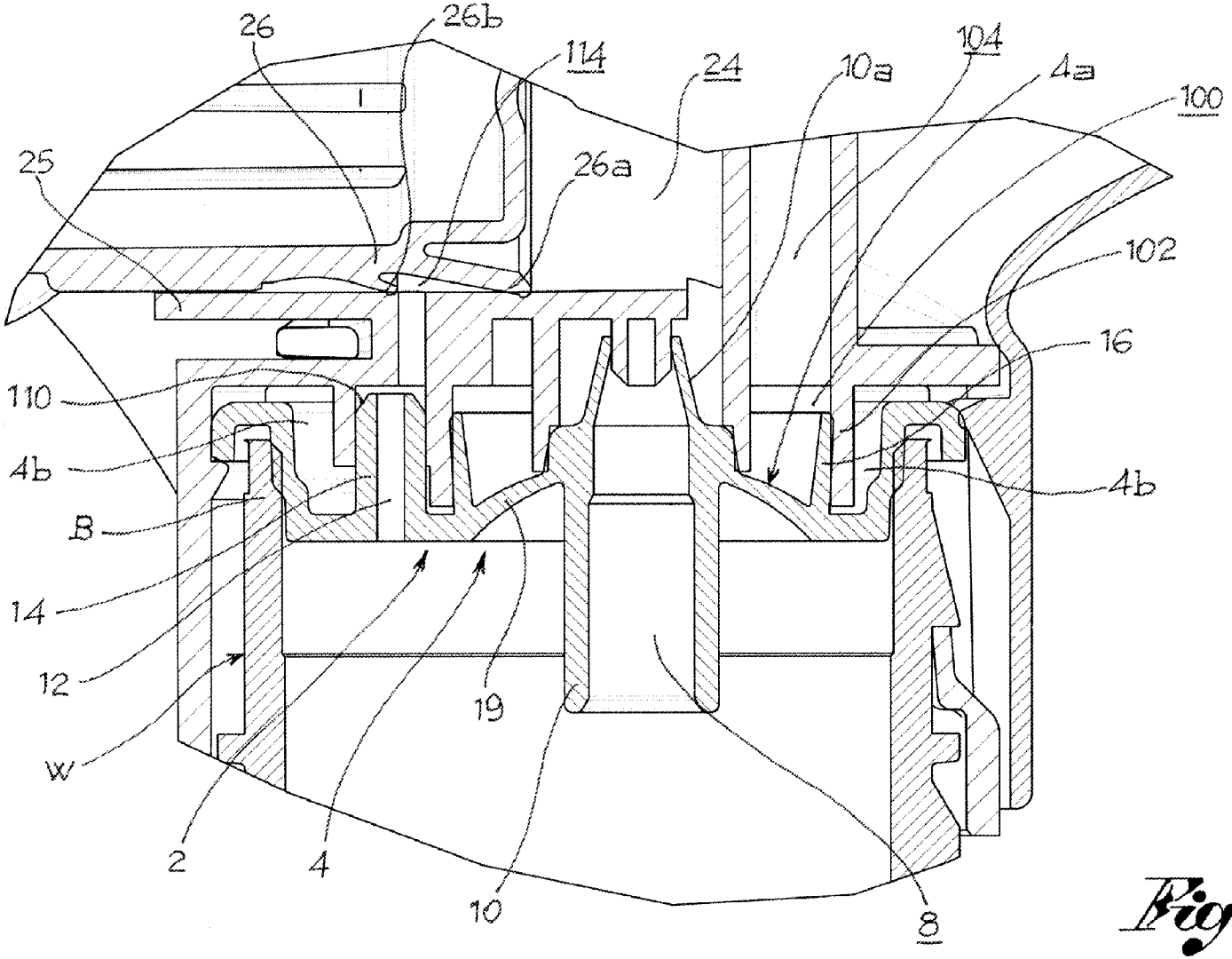
Figure 7A:
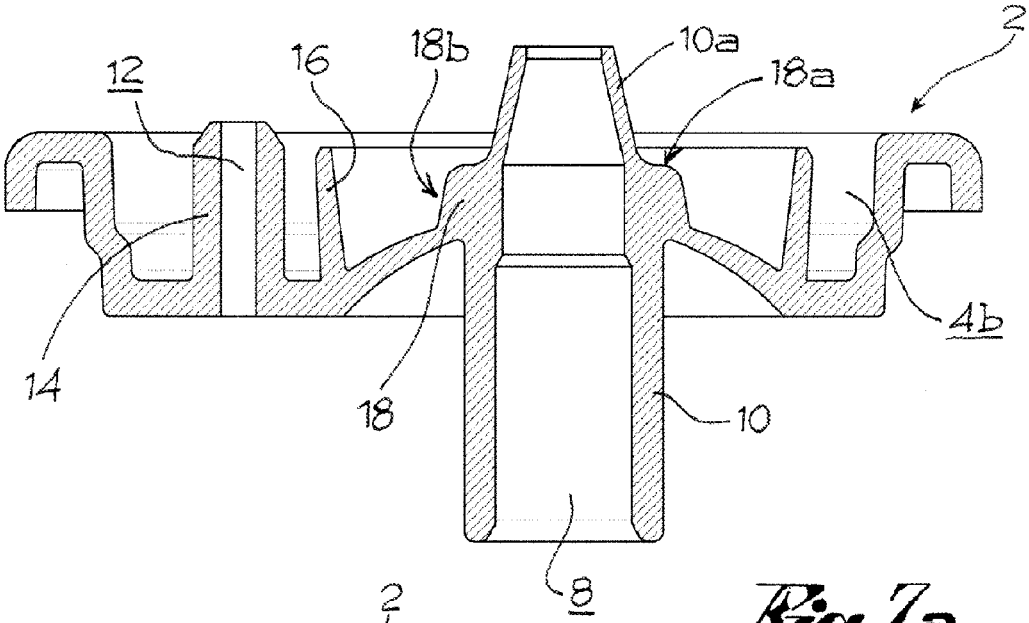
Figure 7B:
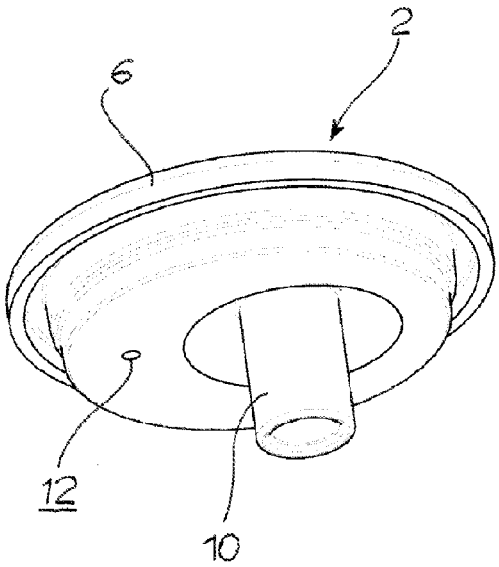
Figure 7C:
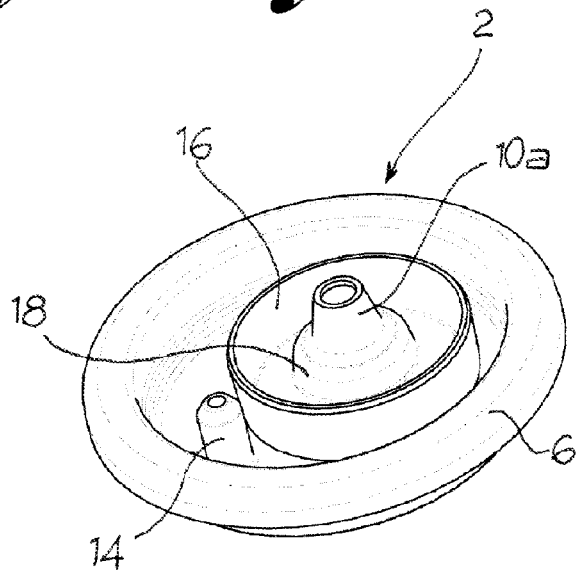

FIG. 5 shows a cross-section view of a neck of the container and the dispenser head attached to it fitted with a valve element, according to a further embodiment of the present invention;

FIG. 6 shows an enlargement of the area VI in FIG. 5;

FIG. 7*a* shows a cross-section view of the valve element in FIG. 5;

FIGS. 7*b* and 7*c* show axonometric views respectively from below and from above of the valve element in FIG. 7*a;*

Figure 8:
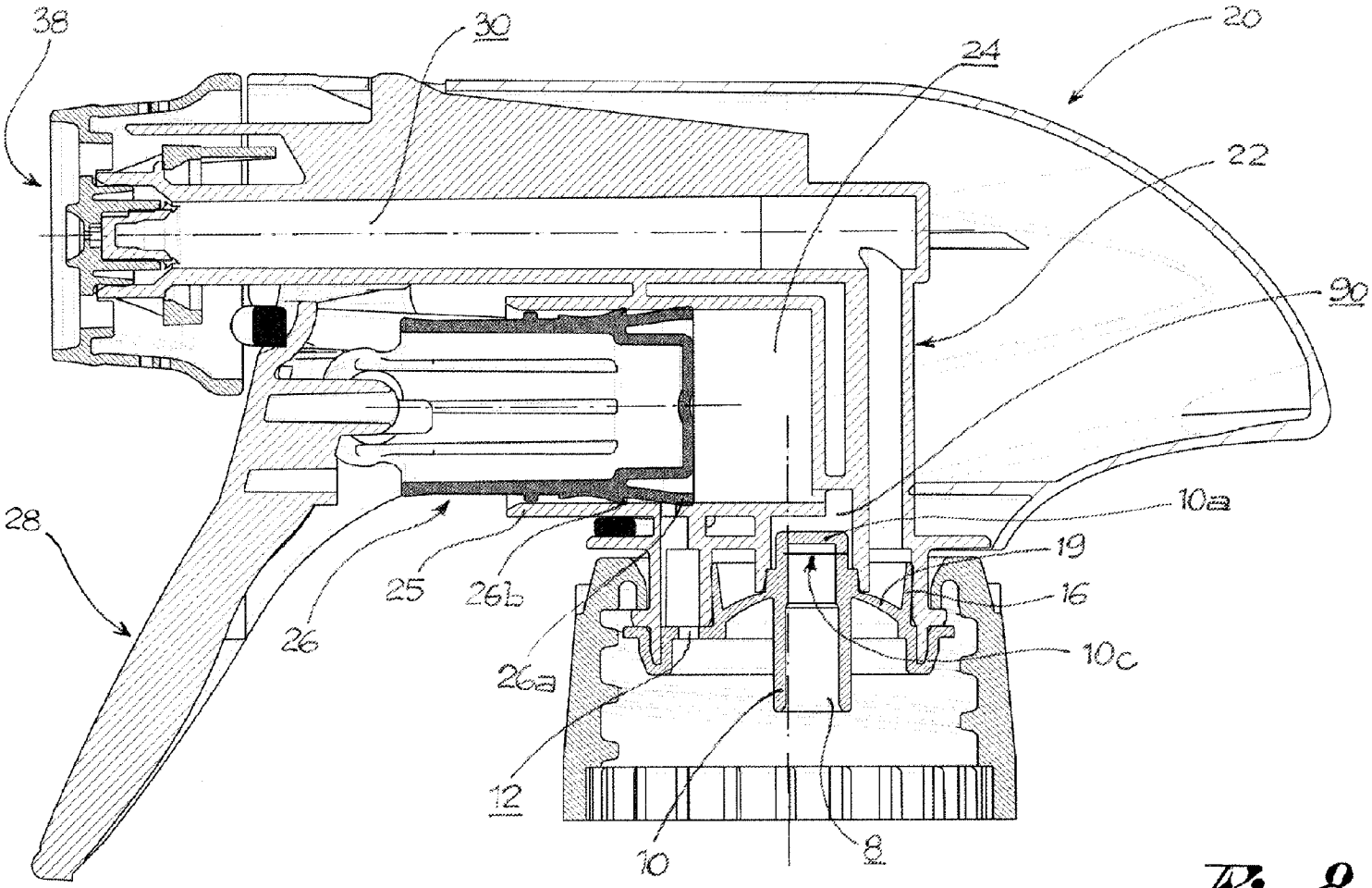

FIG. 8 shows a cross-section view of the dispenser head fitted with the valve element according to yet a further embodiment.

With reference to the appended drawings, reference numeral 1 globally denotes a manually operated dispenser device of a liquid.

The dispenser device comprises a container C to contain the liquid to be dispensed, comprising a neck N made by an annular wall W around a container axis X, which defines by means of an annular rim B, a container aperture A for access to the inside of the same.

The dispenser device comprises a dispenser head 20 attached to the container C to manually aspirate the liquid from the container and dispense it to the outside.

The head 20 is pre-assembled and in general sent for filling of the container separately from it. After filling the container with liquid, the head is coupled to the container.

For example, the head 20 is connectable to the container, for example by a bayonet connection (FIGS. 1 and 5) or a threaded connection (FIG. 8).

The head 20 further comprises a valve element 2 attached to the neck N of the container C, at the aperture A of the same, to close it peripherally forming a seal.

In particular, the valve element 2 comprises a main portion 4, inserted through the aperture A in the neck N, provided with a main surface 4*a* facing the outside of the container, and an annular collar 6, overlapping the annular rim B of the neck N, for example folded so as to straddle said annular rim B.

The collar 6 is made in flexible material, so as to adhere tight with the neck of the container.

Preferably, the auxiliary body 2 has, on the outer side, an annular groove 4*b* which surrounds the main surface 4*a*.

Preferably, the valve element 2 has, on the outer side, an annular groove 4*b* which surrounds the main surface 4*a*.

The valve element 2 has a primary liquid suction duct 8 extending along a suction axis Z, preferably parallel and distanced from the container axis X.

The primary liquid suction duct 8 is passing through the thickness of the main portion 4, placing the compartment inside the container in communication with the main surface 4*a*.

In particular, preferably, the primary liquid suction duct 8 is defined by means of a first tube 10, to which a flexible or rigid feed tube is connectable, which extends as far as the bottom of the container, to suck up the liquid.

Moreover, the valve element 2 comprises a flexible suction lip 10*a* so as to obstruct or free the passage through the suction duct 8.

The suction lip 10*a* is integral with the first tube 10.

Figure 2:
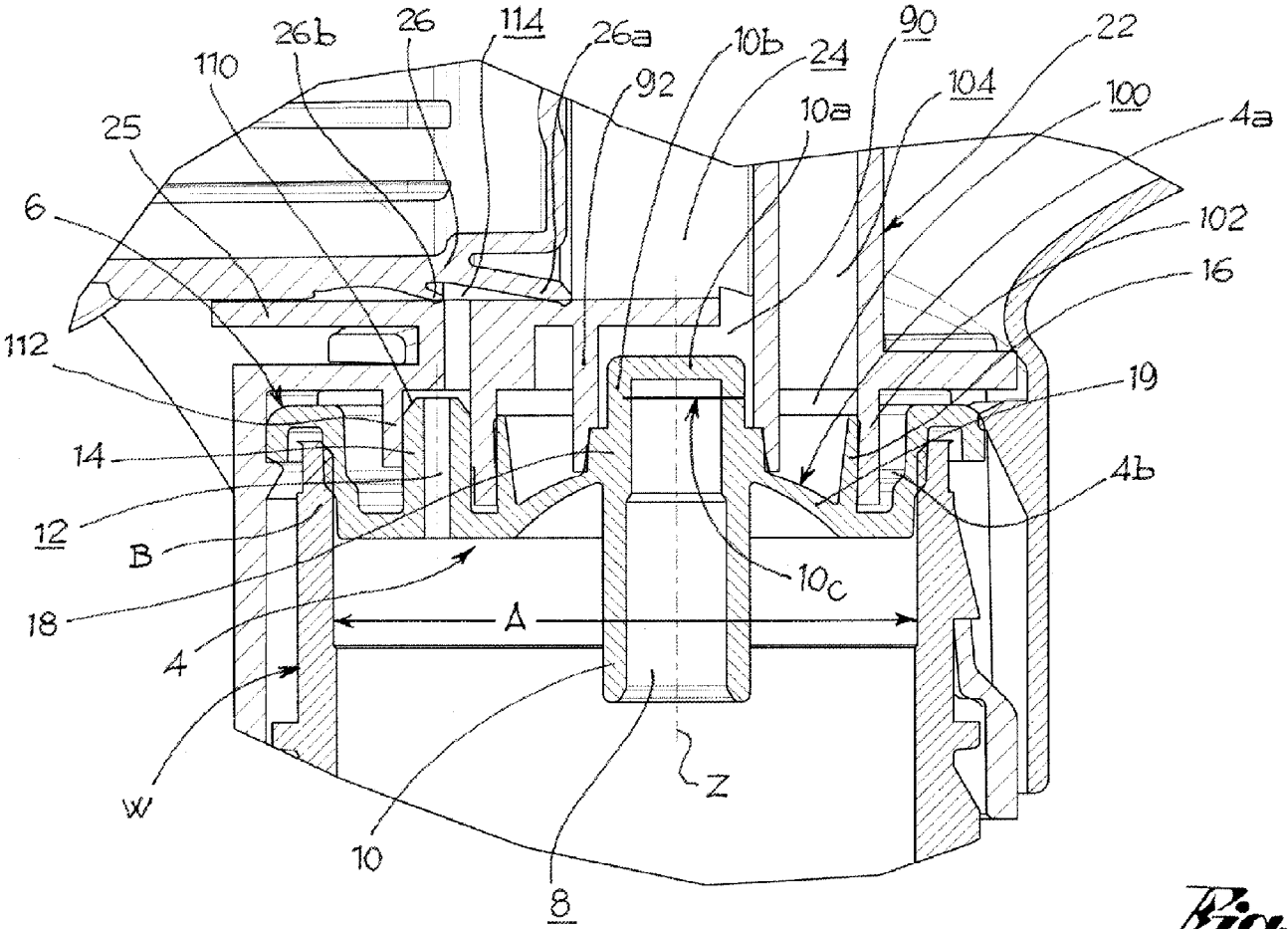
FIG. 2 shows an enlargement of the area II in FIG. 1; wherein the valve element is in an initial rest configuration.
Figure 3:
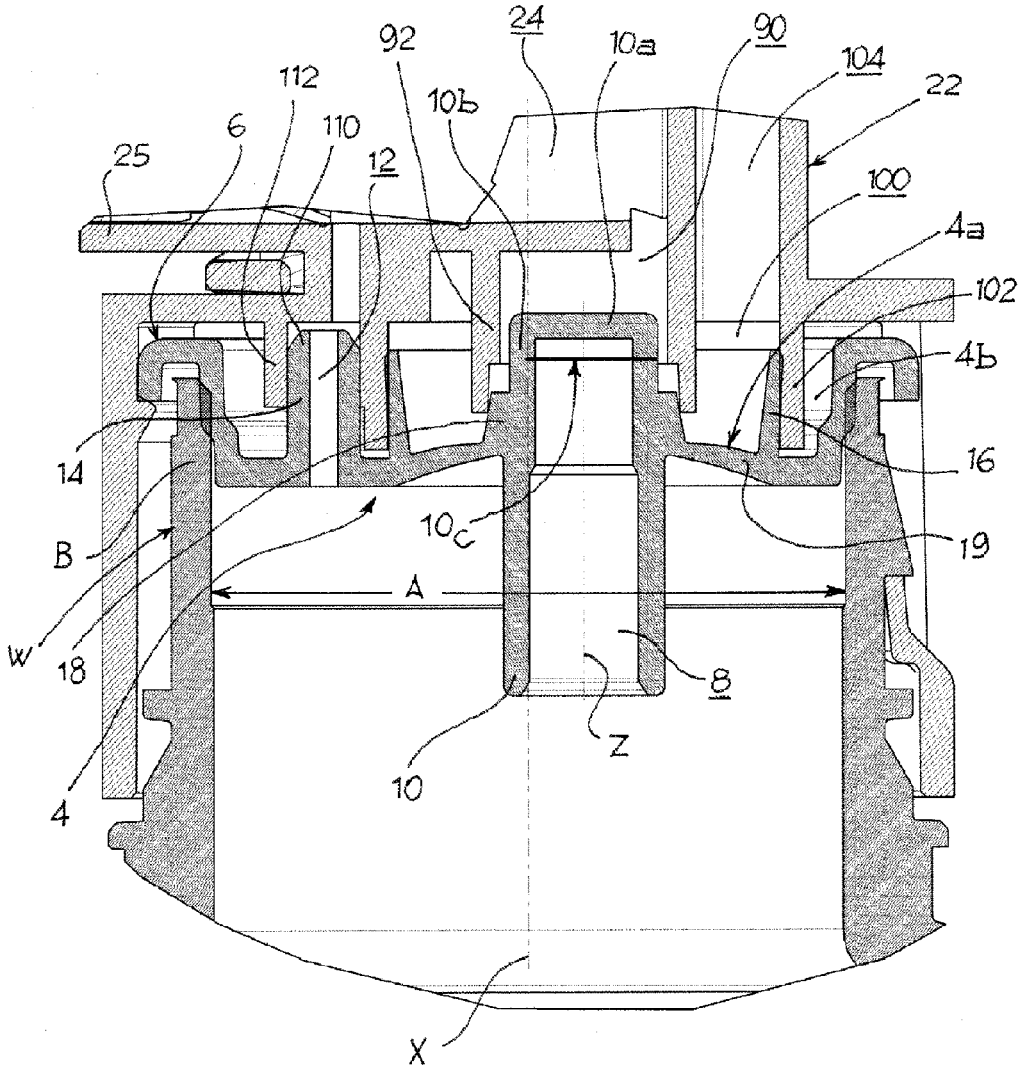
FIG. 3 shows the valve element of FIG. 2 in a dispensing configuration.

According to one embodiment (FIG. 2), the suction lip 10*a* is positioned at the end of the first tube 10 which comes out on the outside of the container, integral with the first tube by means of a junction area 10*b* having a predefined limited angular extension, and separate from the free rim of the first tube 10 by a cut 10*c*.

According to a further embodiment (FIG. 5), the suction lip 10*a* is positioned at the end of the first tube 10 which comes out on the outside of the container, integral with the first tube by its entire angular extension, and with a truncated cone shape converging from the inside towards the outside of the container.

Moreover, the valve elment 2 has a vent duct 12 radially distanced from the primary liquid suction duct 8 passing through the thickness of the main portion 4, to place the outer environment or main surface 4*a* in communication with the compartment inside the container.

In particular, preferably, the vent duct 12 is defined by means of a second tube 14, radially distanced from the first tube 10.

Preferably, the vent duct 12 is positioned radially internally to the annular groove 4*b*.

Moreover, the valve element 2 comprises an annular lip 16, projecting axially from the main surface 4*a*.

Preferably, the annular lip 16 is concentric to the first tube 10, and peripherally defines the annular groove 4*b*, at least partially.

Preferably, moreover, the annular lip 16 is a truncated cone shape, for example diverging away from the main surface 4*a*.

Moreover, the valve element 2 comprises an annular obturator 18, projecting axially from the main surface 4*a*, integral with it.

Preferably, the obturator 18 forms a radial thickening of the first tube 10 and is defined by an abutment crown 18*a*, lying on a plane orthogonal to the suction axis Z, and a lateral surface 18*b*, preferably having a truncated cone shape.

Moreover, the valve element 2 comprises a flexible annular flange 19, projecting radially from the first tube 10.

The flange 19 is integral with the first tube 10 and the obturator 18 projects axially from it, in correspondence with the attachment with the first tube 10.

The flexible, lip 16 and the second tube 14 also project axially from the flange 19.

Said flange 19 ends radially with the collar 6, folded for the engagement with the neck N of the container.

Preferably, the flange 19 is a truncated cone shape, diverging as it moves away from the suction axis Z; preferably, moreover, the flange 19 is arched, dome-shaped and preferably is a variable thickness from the area adjacent to the first tube 10 outwards, preferably of increasing thickness.

Moreover, the head 20 comprises a frame 22 to support the other components and form some passages for the liquid. The valve element 2 is attached to the frame 22.

The frame 22 has a pressure chamber 24, annularly defined by a chamber wall 25, extending along a pressure axis Y, preferably incident to the container axis X, for example orthogonally.

The head 20 comprises a piston 26, sliding in the pressure chamber 24 so as to be airtight along the pressure axis Y, between a rest position, wherein the volume of the pressure chamber 24 is maximum, and a limit dispensing position, wherein the volume of the pressure chamber 24 is minimal, passing through intermediate dispensing positions.

Preferably, the piston 26 comprises a head seal 26*a* and a tail seal 26*b*, distanced from the head seal along the pressure axis Y, for tightness between the piston and the chamber wall 25 in which it slides.

The head 20 further comprises manual actuation devices suitable to move the piston 26 manually in the pressure chamber 24.

Preferably, the operating means comprise a trigger 28, suitable to act on the piston 26, for example anchored to it, and engaged with the frame 22, for example hinged so as to rotate with it or sliding in translation on it.

Preferably, moreover, the head 20 comprises elastic return means able to permanently influence the piston 26 or trigger 28 to return the piston 26 to the rest position.

The frame 22 further presents a dispenser duct 30 extending along a dispensing axis Z, between a distal extremity 32, at the aperture towards the outside, and an opposite proximal extremity 34.

Preferably, the pressure axis Y is parallel and separate from the dispenser axis Z.

The head 20 further comprises, preferably, a nozzle 38, attached to the distal extremity 32 of the dispenser duct 30, to enable dispensing of the liquid in the desired manner.

The frame 22 comprises, preferably, a main mouth 90, formed by a main mouth wall 92, having an axial extension, which defines a compartment in communication with the pressure chamber 24.

The obturator 18 is suitable to couple with the main mouth 90 so as to seal it.

Moreover, the frame 22 comprises a secondary mouth 100, which surrounds the main mouth 90, defined by a secondary mouth wall 102, having an axial extension, which defines a compartment in communication with the dispenser duct 30, for example by means of an intermediate axial duct 104.

The annular lip 16 of the valve element 2 is suitable to couple with the secondary mouth wall 102 so as to seal it.

Moreover, preferably, the frame 22 comprises a vent mouth 110, defined by a vent mouth wall 112, for example, together with a portion of the secondary mouth wall 102, which defines a compartment in communication with the interspace 114 formed between the head seal 26*a* and the tail seal in the cylinder which the piston 26 slides in.

The vent duct 12 communicates with the vent mouth 110 and/or the second tube 14 is suitable to be inserted in the vent mouth 110 so as to seal it.

In an initial rest configuration, the piston 26 is in the rest position and the obturator 18 closes the main mouth 90 so that the pressure chamber 24 is separated from the dispenser duct 30.

Supposing that a quantity of liquid is already present in the pressure chamber 24, by activating the trigger, the piston 26 pushes the liquid out of the pressure chamber towards the main mouth 90.

The liquid acts on the suction lip 10*a* in the sense of closing the suction duct 8 more energically; consequently, the liquid does not return into the container through the suction duct 8.

The liquid acts on the obturator 18 by developing an effect which, after overcoming the resistance of the flange 19, disengages the obturator from the seal with the main mouth, so that the liquid flows out towards the intermediate duct 104 and the dispenser duct 30 for dispensing to the outside.

In other words, the effect of the liquid causes a detachment between the obturator 18 and the wall of the main mouth, is sufficient to create an actual passage opening or a leakage of the liquid towards the dispenser duct.

In yet other words, thanks to the effect of the liquid, the obturator mainly suffers a movement, in particular a rigid translation, which creates a passage opening for the liquid. It is clear that such rigid movement is also accompanied by a minority deformation of the obturator due to the flexibility of the material.

During the dispensing phase, the annular lip 16 maintains the seal on the secondary mouth 100, if need be sliding in contact with the secondary mouth wall 102.

When the trigger is released, the elastic return means move the piston 26 or the trigger 28 from the dispensing limit position towards the rest position.

In the return phase, the piston 26 performs a return stroke from the dispensing limit position towards the return position.

The negative pressure which forms in the pressure chamber 24 and the elastic return of the flange 19, return the obturator to sealed engagement with the main mouth.

The negative pressure which forms in the pressure chamber 24 flexes the suction lip 10*a* so as to open the suction duct 8 towards the pressure chamber 24. The liquid contained in the container is thus aspirated through the first tube 10, and the main mouth 90, reaching the pressure chamber 24.

At least for a part of the return phase, the vent mouth 110 is in communication with the outside environment, so that the air can be aspirated into the compartment inside the container.

The obturator 18, which is engageble with the main mouth 90 so as to seal it, and the flexible flange 19 which supports it, form an example of valve dispenser means integral with the valve element, suitable for allowing the transit of liquid from the pressure chamber towards the dispenser duct during the dispensing phase and to prevent the suction of air from the dispenser duct towards the pressure chamber during the return phase.

The flexible suction lip 10*a*, which is engageble with the suction duct 8 so as to seal and obstruct it, forms an example of valve suction means integral with the valve element, suitable to allow the transit of liquid from the container towards the pressure chamber during the return phase and to prevent the return of the liquid from the pressure chamber to the container during the dispensing phase.

Innovatively, the dispenser device according to the present invention makes it possible to concentrate the valve functions in a single valve element at the same time ensuring efficacious dispensing, thanks to the resistance opposed by the dispenser valve means.

Advantageously, moreover, the dispenser device according to the invention makes it possible to concentrate the sealing functions also in a single valve element, for example between the container and the dispenser duct and/or between the container and the outside environment.

According to a further advantageous aspect, the dispenser device according to the invention makes it possible to concentrate in a single valve element the attachment of the feed tube and/or the tube for the suction of the air separated from the dispenser duct.

It is clear that a person skilled in the art may make modifications to the dispenser device described above so as to satisfy specific requirements. Such modifications are also contained within the sphere of protection as defined by the appended claims.

The invention claimed is:

1. A trigger operated liquid dispenser device, comprising:

a container provided with a neck and having an inner compartment to contain a liquid to be dispensed;

a dispenser head attachable to the neck and comprising a frame in which a pressure chamber is made;

a manually activated piston, slidable sliding sealingly in the pressure chamber between an initial rest position, wherein the volume of the pressure chamber is maximum, and a limit dispensing position, wherein the volume of the pressure chamber is minimal;

a dispenser duct suitable for being placed in communication with the pressure chamber for transit of the liquid being dispensed;

an integral valve element, applicable to the frame and/or to the neck of the container, comprising:

a) a suction duct and at least one flexible suction lip suitable for obstructing the suction duct, to realise valve suction means suitable to permit the transit of liquid from the inner compartment to the pressure chamber during a suction phase and suitable to prevent the return of the liquid from the pressure chamber to the compartment during a dispensing phase;

b) an annular obturator positioned radially externally to the suction duct and a flexible flange projecting radially externally to the suction duct, which supports the obturator, to form a valve dispenser, wherein the annular obturator is configured to contact a wall to selectively seal the pressure chamber from the dispenser duct, allow transit of liquid from the pressure chamber to the dispenser duct during the dispensing phase, and to prevent the return of the liquid from the dispenser duct to the pressure chamber during the suction phase.

2. The device according to claim 1, wherein the obturator mainly performs a rigid translation from the limit rest position to the dispensing position.

3. The device according to claim 1, wherein the flange is dome-shaped.

4. The device according to the claim 1, wherein the obturator has a truncated cone lateral surface.

5. The device according to claim 1, wherein the suction lip is separated from the walls of the suction duct by a partial cut.

6. The device according to claim 1, wherein the suction lip is a truncated cone shape and is continuously joined to a rim of the suction duct wall.

7. The device according to claim 1, wherein the valve element comprises a flexible sealing lip, projecting axially from the flange.

8. The device according to claim 7, wherein the sealing lip is radially external to the obturator.

9. The device according to claim 7, wherein the sealing lip (16) is a truncated cone shape.

10. The device according to claim 1, wherein the valve element has a vent duct delimited by a second tube projecting axially.

11. The device according to claim 1, wherein the valve element comprises a flexible peripheral collar for sealed anchorage to the neck.

12. The device according to claim 1, wherein the suction duct is delimited by a first axially flexible tube projecting towards the compartment for the insertion of a feed tube.

13. The device according to claim 1, wherein the frame comprises a main mouth communicating with the pressure chamber, separable from the dispenser duct by the obturator and/or from the suction duct by the suction lip.

14. The device according to claim 1, wherein the valve element comprises a flexible sealing lip projecting axially from the flange, and wherein the frame comprises a secondary mouth which the sealing lip acts on so as to seal.

15. The device according to claim 1, wherein the valve element has a vent duct delimited by a second tube projecting axially, and wherein the frame comprises a vent mouth suitable for being placed in communication with an external environment.

16. The device according to claim 1, wherein a suction axis of the suction duct is orthogonal and incident to the dispensing direction of the liquid.

* * * * *